US009901175B2

(12) United States Patent
Chen

(10) Patent No.: US 9,901,175 B2
(45) Date of Patent: Feb. 27, 2018

(54) ARMREST ADJUSTER

(71) Applicant: ATEC INTERNATIONAL TEAM CO., LTD., Taoyuan (TW)

(72) Inventor: Te-Chun Chen, Taoyuan (TW)

(73) Assignee: Atec International Team Co., Ltd., Taoyuan (TW)

( * ) Notice: Subject to any disclaimer, the term of this patent is extended or adjusted under 35 U.S.C. 154(b) by 0 days.

(21) Appl. No.: 15/149,893

(22) Filed: May 9, 2016

(65) Prior Publication Data

US 2017/0318966 A1 Nov. 9, 2017

(51) Int. Cl.
*A47C 7/54* (2006.01)
*A47C 1/03* (2006.01)

(52) U.S. Cl.
CPC . *A47C 1/03* (2013.01); *A47C 7/54* (2013.01)

(58) Field of Classification Search
CPC ..... A47C 1/03; A47C 7/54
See application file for complete search history.

(56) References Cited

U.S. PATENT DOCUMENTS 6,074,012 A * 6/2000 Wu ..... A47C 1/03 297/411.26
7,367,628 B1 * 5/2008 Tsai ..... A47C 1/03 297/411.35
8,226,171 B2 * 7/2012 Fang ..... A47C 1/03 297/411.35
8,474,914 B2 * 7/2013 Chen ..... A47C 1/03 297/411.35
8,960,801 B2 * 2/2015 Hu ..... A47C 7/54 297/115
9,004,603 B1 * 4/2015 Wang ..... A47C 7/54 297/411.35
2008/0084103 A1 4/2008 Bock
2013/0264855 A1 * 10/2013 Huang ..... A47C 1/03 297/411.35

* cited by examiner

*Primary Examiner* — Philip F Gabler
(74) *Attorney, Agent, or Firm* — Muncy, Geissler, Olds & Lowe, P.C.

(57) ABSTRACT

An armrest adjuster includes a slider, a fixing member moveably mounted into a concave space of the slider, and a button is revealed. Two pins set on a bottom surface of the fixing member are moveably mounted in two long grooves on a bottom surface of the slider respectively. Each pin is set with a through hole for being fastened on a top of a vertical support of an armrest. The button exposed is clipped between the slider and the fixing member. The button is disposed with a rack while another rack corresponding to the rack of the button is arranged at the fixing member. The rack of the button is separated from the rack of the fixing member when the button is pressed. Thus the slider is moved horizontally relative to the fixing member. The design is beneficial to the assembly process, modularization and mass production.

9 Claims, 7 Drawing Sheets

ARMREST ADJUSTER

BACKGROUND OF THE INVENTION

The present invention relates to an armrest adjuster, especially to an armrest adjuster that is formed by a slider, a fixing member and a button and is able to be disposed on a top of a vertical support of an armrest conveniently.

For convenience and comfort of users, an armrest is disposed with various adjustment mechanisms. Yet the design and production of these adjustment mechanisms should meet the requirements of mass-production and cost constraints for higher market competitiveness.

Generally, an armrest includes an armrest support and an armrest pad. The armrest support is fastened and fixed on the right side and the left side of a seat while the armrest pad is connected to and covered a top of a vertical support of the armrest support. A conventional armrest adjuster consists of a horizontal adjustment member (to-and-fro or left-and-right) and a height adjustment member. The horizontal adjustment member is fastened and assembled on the top of the vertical support of the armrest support or a top of a T-shaped rack. The height adjustment member is mounted and hidden in the vertical support of the armrest support. For example, a multi-function bearing head is disposed on the armrest, with a rotational, longitudinal and lateral adjustment mechanism for the arm support in an armrest, in particular for an office chair US2008/0084103. However, the conventional armrest adjuster has shortcomings of more components used and complicated structure. Thus the assembly of the armrest is troublesome and inconvenience. Before being assembled, the respective components of the adjuster are delivered to a workstation. Then operators fasten the components on an armrest support in turn so as to get an armrest product at once. Or the respective components can be assembled to form a semi-finished product (or a module), which is used in the following assembly. Yet the components of the semi-finished product (the module) are assembled from the top down to the bottom or from the bottom up to the top, not integrated into one part. Thus the semi-finished product (the module) may be separated, loosened or lost during transportation or the following assembly process due to direction change or inverted position. This causes negative effects on the following assembly process, production management, mass production and market competitiveness of the armrest.

SUMMARY OF THE INVENTION

Therefore it is a primary object of the present invention to provide an armrest adjuster that is easy and convenient to be transported, assembled, modularized and mass produced.

In order to achieve the above object, an armrest adjuster according to the present invention includes a slider, a fixing member, and a button is revealed. The fixing member is moveably mounted into a concave space of the slider. A bottom surface of the fixing member is disposed with two pins while a bottom surface of the slider is arranged with two long grooves. The pins are moveably mounted in the long grooves respectively and each pin is set with a through hole for being fastened on a top of a vertical support of an armrest. Thus an armrest pad of the armrest is set on the slider and is adjusted along with the horizontal movement of the slider. The button clipped between the slider and the fixing member and is exposed and pressed by users to be moved in or turned back elastically. The button is disposed with a rack while another rack corresponding to the rack of the button is arranged at the fixing member. The rack of the button can be engaged with or separated from the rack of the fixing member. When the button is pressed, the rack of the button is separated from the rack of the fixing member so that the slider is moved horizontally relative to the fixing member and the position of the armrest pad is also adjusted along with the movement of the slider. Thereby the design of the armrest adjuster is beneficial to transportation, the following assembly process, modularization and mass production.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
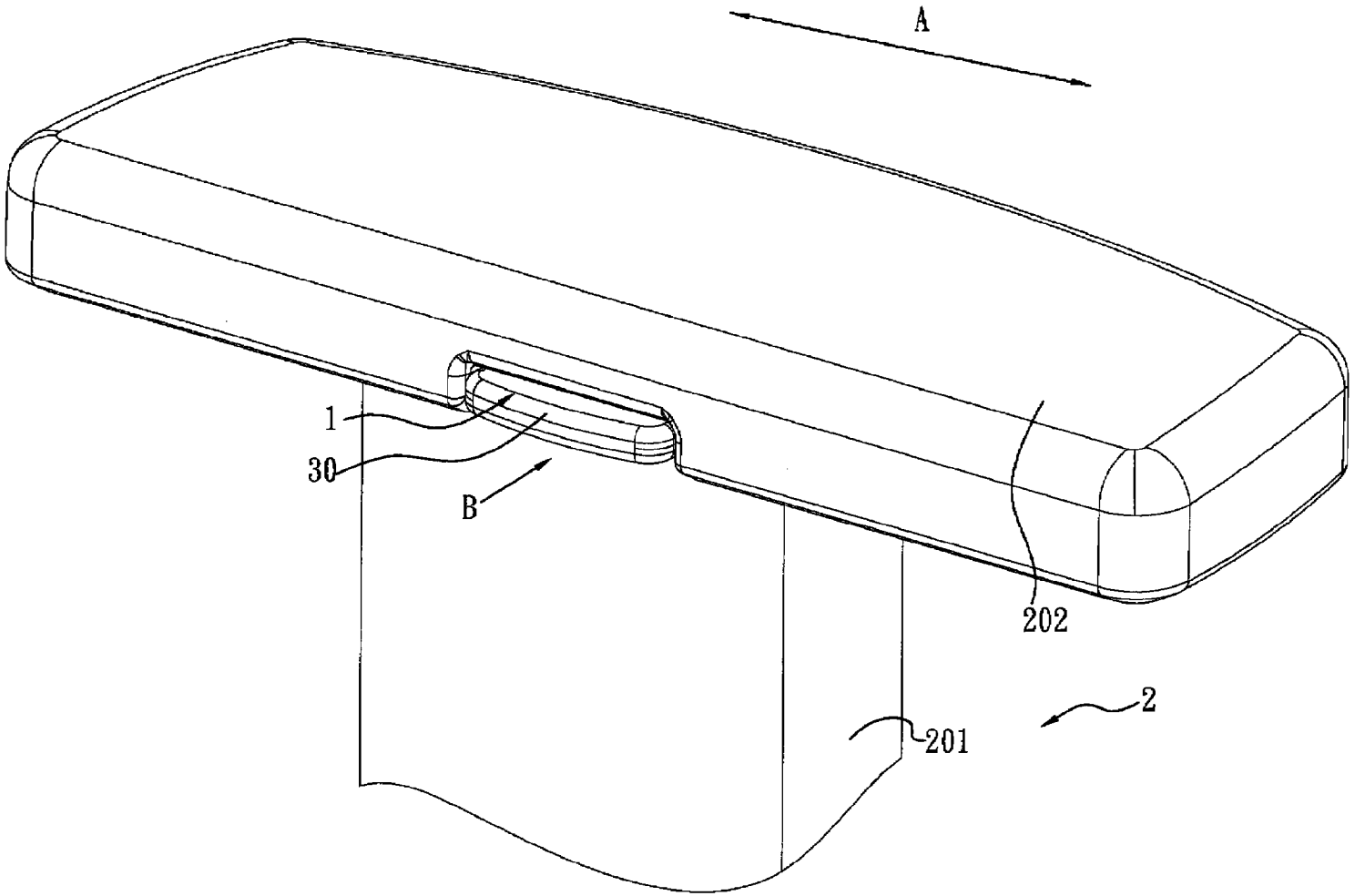
FIG. 1 is a schematic drawing showing an embodiment of an armrest adjuster disposed on a vertical support of an armrest according to the present invention.

Refer to FIG. 1, an armrest adjuster 1 of the present invention is set on a top of a vertical support 201 of an armrest 2. Thus an armrest pad 202 of the armrest 2 can be moved horizontally, as the arrow A in FIG. 1 and FIG. 7 indicates. The armrest adjuster 1 mainly includes a slider 10, a fixing member 20 and a button 30.

Figure 2:
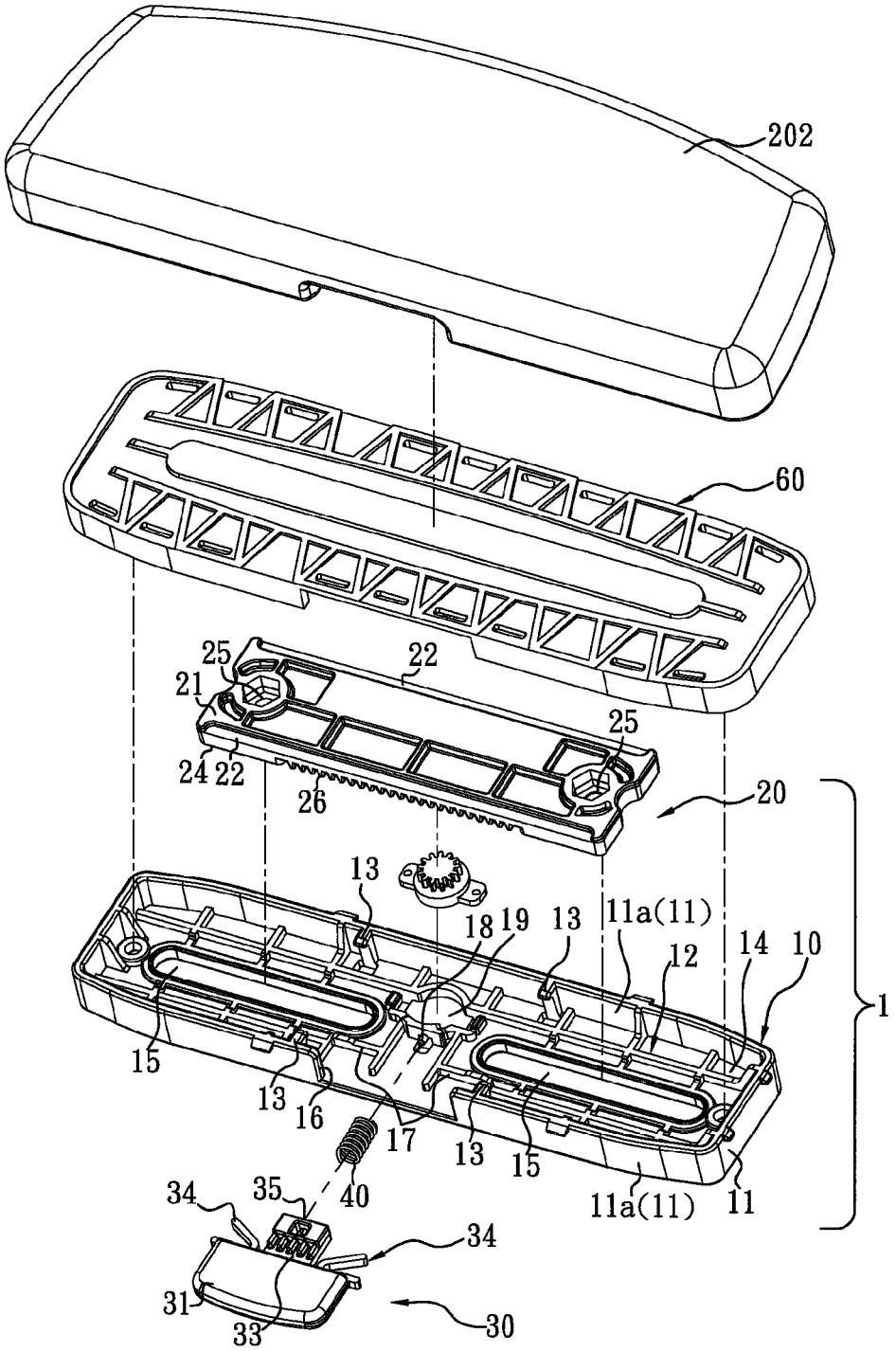
FIG. 2 is an explosive view of an embodiment of an armrest adjuster according to the present invention.
Figure 3:
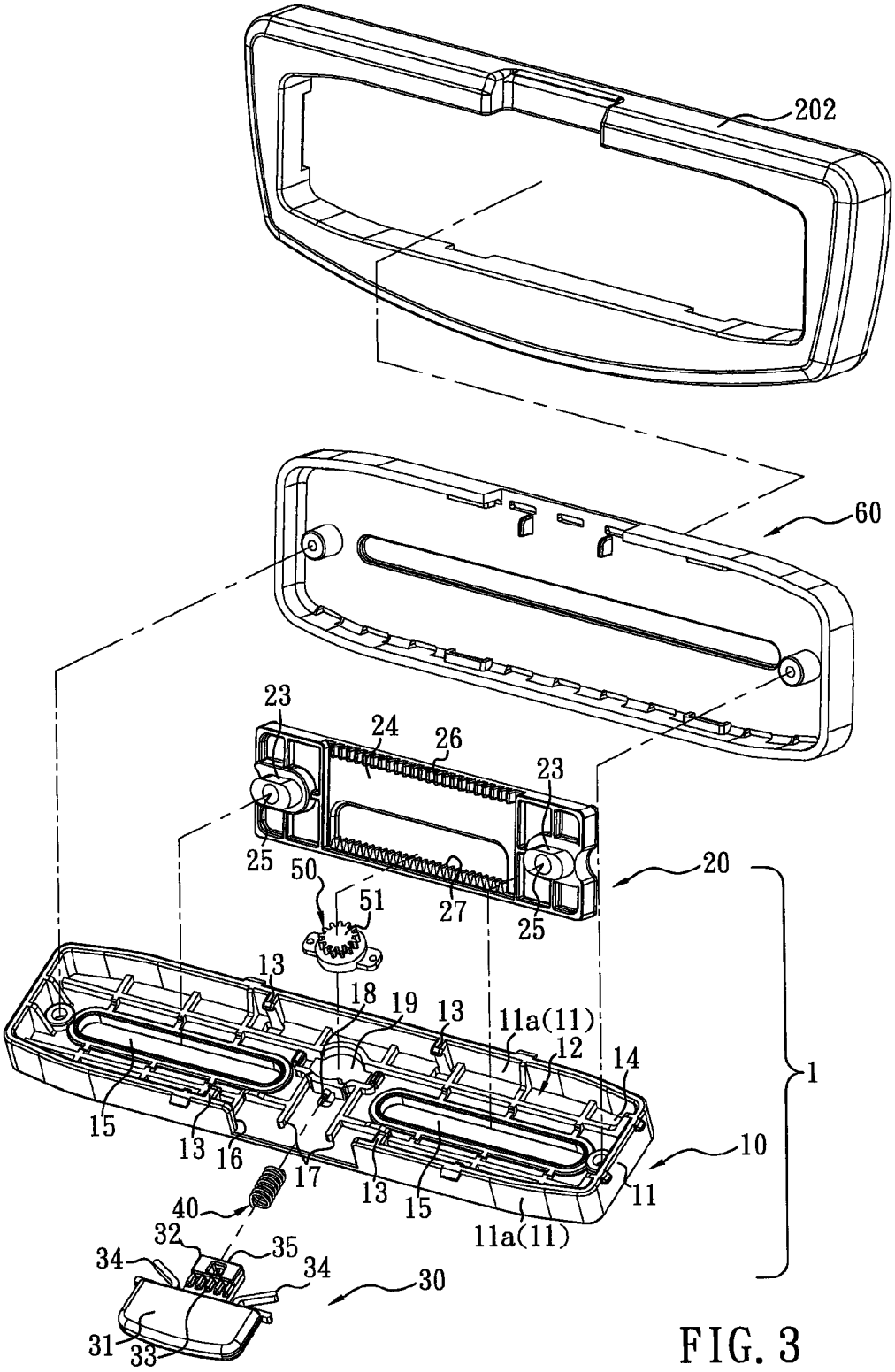
FIG. 3 is another explosive view of an embodiment of an armrest adjuster according to the present invention.

Refer to FIG. 2 and FIG. 3, the slider 10 is a long housing formed by an enclosed wall 11 therearound, a concave space 12 formed in the enclosed wall 11, at least one hook 13, a bottom surface 14 thereof, two linear long grooves 15, a notch 16 and at least one stopping rib 17. The armrest pad 202 of the armrest 2 is connected to the top of the slider 10. The hook 13 is projecting inward and disposed on an inner surface of a left side or a right side of the enclosed wall 11*a*. In this embodiment, there are four hooks 13 arranged at the inner surfaces of the left side and the right side of the enclosed wall 11*a*. The long grooves 15 are formed on the bottom surface 14 under the concave space 12 while the notch 16 is set on either the left side or the right side of the enclosed wall 11*a*. The stopping rib 17 is projecting from and disposed on the bottom surface 14 under the concave space 12, closed to the notch 16.

As shown in FIG. 2 and FIG. 3, the fixing member 20 is a long plate having a length shorter than the length of the slider 10 and being mounted into the concave space 12 of the slider 10. The fixing member 20 consists of a top surface 21, two long slots 22, two pins 23, a bottom surface 24 thereof, two through holes 25, and at least one rack 26. The long slots 22 are arranged at the left side and the right side of the top surface 21 respectively and corresponding to the hooks 13 of the slider 10. Thus the hooks 13 are pressed against and slidable in the long slots 22 due to the long slots 22. The pins 23 are disposed on the front end and the rear end of the bottom surface 24 respectively while each pin 23 is mounted and sliding in the long groove 15 of the slider 10 correspondingly. The through hole 25 is set on the pin 23 and used for fastening and fixing the fixing member 20 on the top of the vertical support 201 of the armrest 2 (the fastening way is not shown in the figures). The rack 26 is set on an edge of either the left side or the right side of the bottom surface 24 and corresponding to the notch 16 of the slider 10.

The button 30 is moveably mounted into the notch 16 of the slider 10 and clipped between the slider 10 and the fixing member 20. The button 30 is composed of a press portion 31, a projecting portion 32, a rack 33 and at least one elastic portion 34. The press portion 31 is exposed outside the notch 16 to be pressed by users while in use. The projecting portion 32 is integrally disposed on one side of the press portion 31 and extended toward the concave space 12 of the slider 10. The rack 33 is integrated on the top surface of the projecting portion 32 and used for being engaged with or separated from the rack 26 of the fixing member 20. The elastic portion 34 provides an elastic recovery force to the button 30 being pressed.

Figure 4:
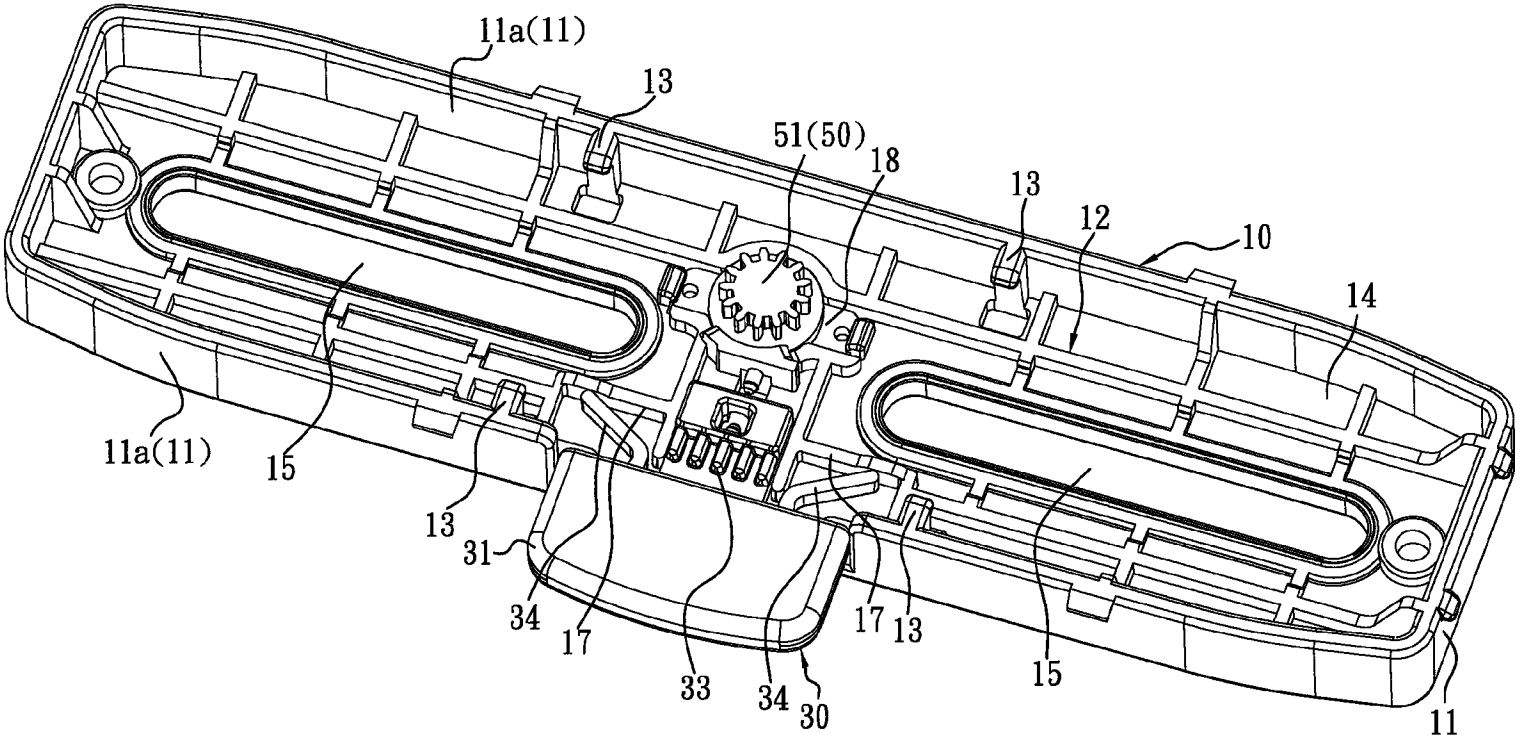
FIG. 4 is a perspective view showing a button and a slider assembled with each other in an embodiment according to the present invention.
Figure 5:
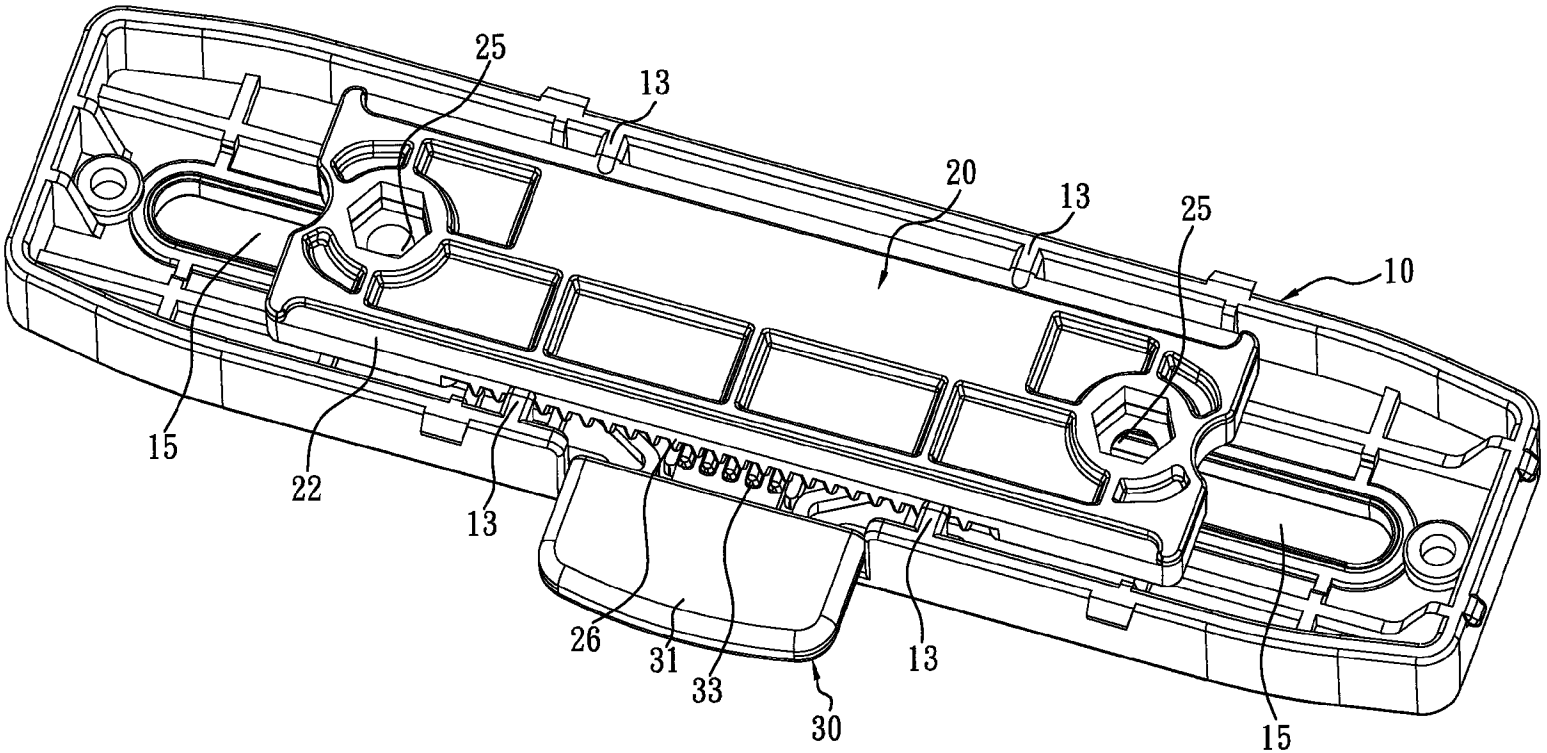
FIG. 5 is a perspective view showing a button, a slider and a fixing member assembled with one another in an embodiment according to the present invention.

Refer to FIG. 4 and FIG. 5, the slider 10, the fixing member 20 and the button 30 are integrated into one module and connected tightly by the hooks 13 of the slider 10 being pressed against the long slots 22 of the fixing member 20 when the fixing member 20 is pressed by a force applied to be passed through the hooks 13 of the slider 10 and mounted in the concave space 12 of the slider 10. The design is beneficial to modularization and the following assembly process.

Figure 6:
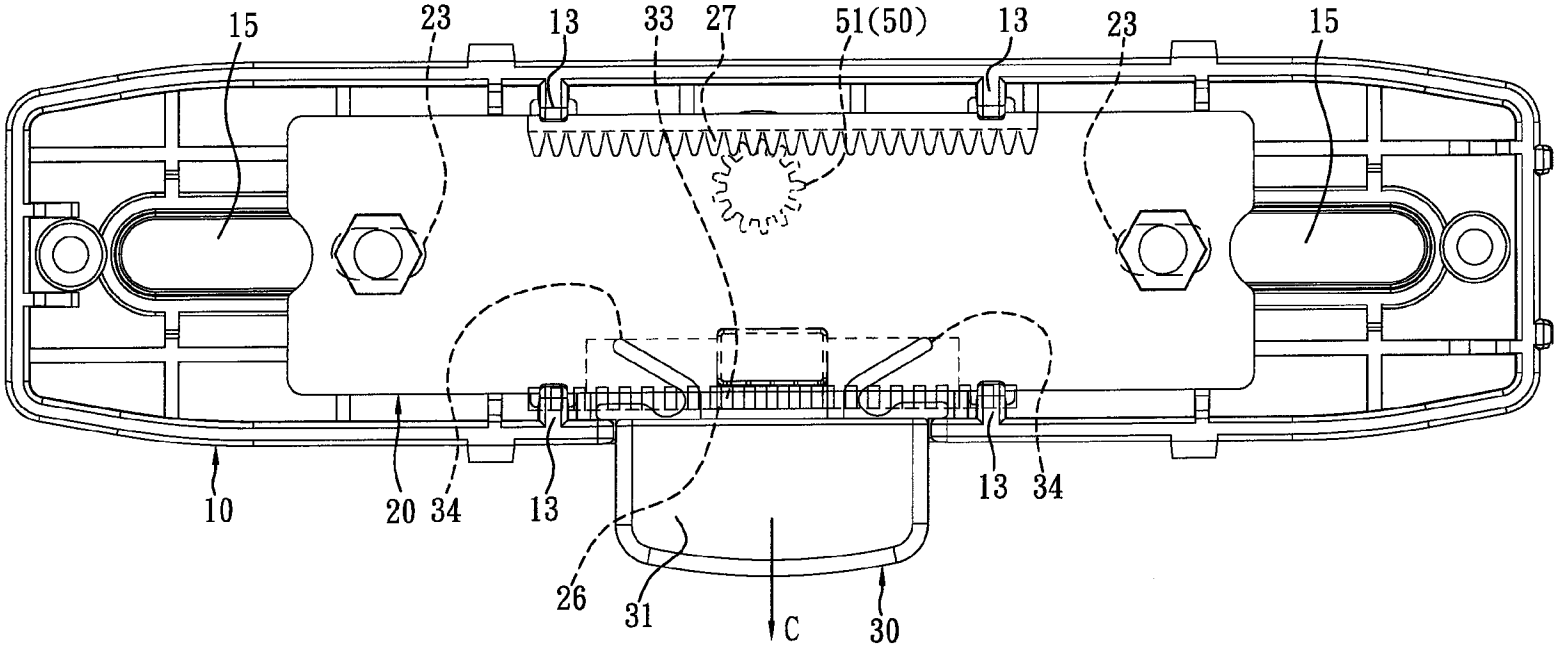
FIG. 6 is a top view of an embodiment of an armrest adjuster without being adjusted according to the present invention.
Figure 7:
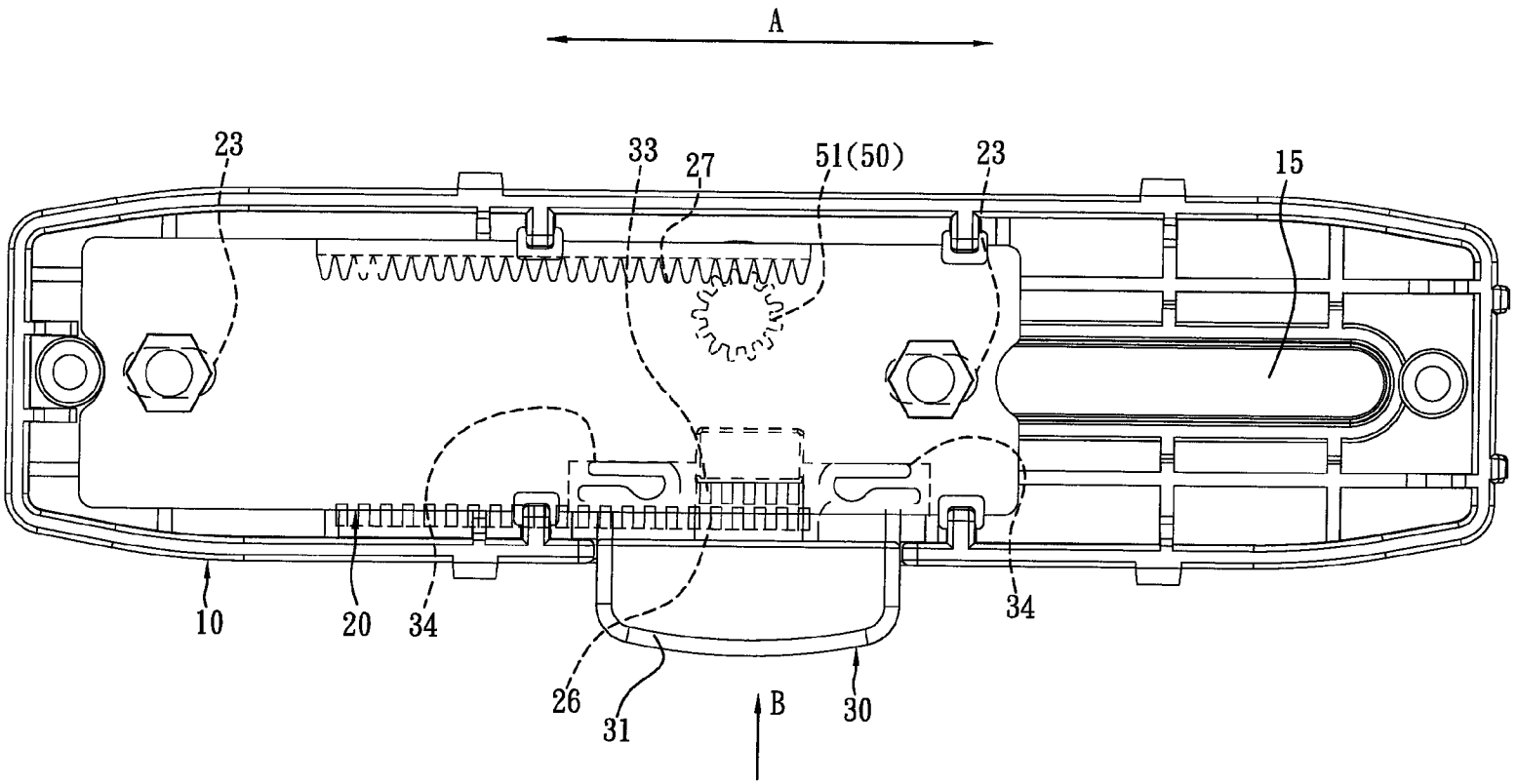
FIG. 7 is a top view of an embodiment of an armrest adjuster being adjusted according to the present invention.

Refer to FIG. 6 and FIG. 7, the elastic portion 34 is against the stopping rib 17 of the slider 10 to be compressed and deformed elastically when the button 30 is pressed and moved into the concave space 12 of the slider 10, as the arrow B in the FIG. 7 indicates. Thus the rack 33 of the button 30 is moved away from the rack 26 of the fixing member 20 and the slider 10 is moved forward and backward relative to the fixing member 20 for adjustment of the position of the armrest pad 202 relative to the vertical support 201 of the armrest 2, as the double-headed arrow A in FIG. 7 indicates.

Also refer to FIG. 6 and FIG. 7, after adjustment of the slider 10 and no force being applied to press the button 30, the button 30 is turned back to the original position by the elastic force of the elastic portion 34, as the arrow C in FIG. 6 indicates. The rack 33 is also moved back and engaged to the rack 26 of the fixing member 20 again at a new position. At the moment, the slider 10 is positioned and unable to be moved horizontally relative to the fixing member 20. The armrest pad 202 is also positioned at a new position relative to the vertical support 201 of the armrest 2 after the adjustment.

In the embodiment shown from FIG. 2 to FIG. 7, the slider 10 is a long housing with left-right symmetry. Thus the armrest pad 202 disposed over and connected to the slider 10 can be integrated into the armrest 2 on the left side or the right side of a chair.

The elastic portion 34 of the button 30 includes at least one elastic pin (34) extended in an inclining manner that is integrated into the press portion 31 and located at the same side as the projecting portion 32. The elastic pin (34) is inclined toward the concave space 12 of the slider 10 and used for against the stopping rib 17 of the slider 10 to form a pressed state.

In the embodiment shown in FIG. 2 and FIG. 3, the elastic portion 34 includes two elastic pins (34) extended inclingly and arranged symmetrically at two lateral sides of the projecting portion 32 respectively.

Refer to FIG. 2 and FIG. 3, a head end of the projecting portion 32 of the button 30 is further disposed with a spring-fixing end 35 while the slider 10 is arranged with a spring-fixing end 18 that is corresponding to the spring-fixing end 35 of the button 30. A compression spring 40 is positioned between the spring-fixing end 35 and the spring-fixing end 18 and used for providing the elastic recovery force by which the button 30 being pressed is turned back to the original position.

Moreover, another rack 27 facing inward is disposed on one side of the fixing member 20 opposite to the side of the fixing member 20 with the rack 26. The bottom surface 14 of the concave space 12 of the slider 10 is set with a groove 19 while a rotary damper 50 is mounted in the groove 19. Thus the rack 27 on the fixing member 20 can be engaged with a gear 51 that rotates on the rotary damper 50 for damping. Thereby the slider 10 can be moved and sliding relative to the fixing member 20 more stably and smoothly. During the horizontal movement of the slider 10 relative to the fixing member 20, as the double-headed arrow A in FIG. 7 indicates, the movement is retarded and slowed down by the rotary damper 50 engaged with the rack 27 of the fixing member 20. Thus the slider 10/or the armrest pad 202 is moved stably, smoothly and quietly during the adjustment.

Furthermore, the armrest adjuster 1 of the present invention further includes a top cover 60 disposed over the slider 10 and the fixing member 20. The top cover 60 can be connected to the slider 10 and the fixing member 20 by pin-and-hole engagement or screws. The connection is not limited to a specific way. The armrest pad 202 of the armrest 2 is covered over the top cover 60.

In summary, the armrest adjuster 1 of the present invention features on simple structure, fewer components, simplified assembly and easy production. For example, the integrated part can be produced by plastic injection molding. These features are beneficial to transportation, the following assembly process, modularization and mass production.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An armrest adjuster disposed on a top of a vertical support of an armrest and used for adjustment of an armrest pad of the armrest comprising:

a slider that is a longitudinal housing and having an enclosed wall therearound, a concave space formed in the enclosed wall, at least one hook projecting from an inner surface of a left side or a right side of the enclosed wall toward the concave space, a bottom surface thereof, two linear longitudinal grooves arranged at the bottom surface respectively, a notch set on either the left side or the right side of the enclosed wall, and at least one stopping rib that is projecting from the bottom surface, disposed on the bottom surface, and located close to the notch;

a fixing member that is a longitudinal plate mounted in the concave space of the slider, having a length shorter than a length of the slider and including a top surface, two longitudinal slots arranged at a left side and a right side of the top surface respectively for pressing the hook of the slider against the longitudinal slot and for allowing the hook to be moveable in the longitudinal slot, a bottom surface thereof, two pins disposed on a front end and a rear end of the bottom surface of the fixing member respectively while each pin is mounted and slidable in the longitudinal groove of the slider correspondingly, two through holes each of which is set in the pin and used for fastening and fixing the fixing member on the top of the vertical support of the armrest, and at least one rack arranged at an edge of the bottom surface thereof and corresponding to the notch of the slider; and a button that is moveably mounted into the notch of the slider, clipped between the slider and the fixing member, and having a press portion exposed outside the notch for being pressed, a projecting portion integrally disposed on one side of the press portion and extended toward the concave space of the slider, a rack integrated on a top surface of the projecting portion and used for being engaged with or separated from the rack of the fixing member, and at least one elastic portion used for providing an elastic force to the button being pressed;

wherein the slider, the fixing member and the button are integrated into one module and connected firmly by the hook of the slider being pressed against the longitudinal slot of the fixing member when the fixing member is pressed by a force applied to be passed through the hook of the slider and mounted in the concave space of the slider;

wherein the elastic portion is compressed and deformed elastically when the button is pressed and moved into the concave space of the slider so that rack of the button is moved away from the rack of the fixing member; thus the slider is able to be moved horizontally and longitudinally relative to the fixing member for adjustment of the armrest pad relative to the vertical support of the armrest;

wherein when the button is turned back by an elastic force provided by the elastic portion, that the rack of the button is moved back and engages the rack of the fixing member again at a new position so that the slider is unable to be moved horizontally and longitudinally relative to the fixing member and the armrest pad is positioned at a new position after the adjustment of the armrest pad relative to the vertical support of the armrest.

2. The device as claimed in claim 1, wherein the slider is the longitudinal housing arranged in left-right symmetry that allows the armrest pad over the slider integrated into the armrest on the left side or the right side of a chair.

3. The device as claimed in claim 1, wherein the elastic portion of the button includes at least one elastic pin that is extended in an inclining manner and integrated into the press portion; the elastic pin is located at the side of the press portion disposed with the projecting portion and inclined toward the concave space of the slider for pressing against the stopping rib of the slider to form a pressed state.

4. The device as claimed in claim 3, wherein the elastic portion of the button includes two elastic pins extended inclingly and arranged symmetrically at two lateral sides of the projecting portion respectively.

5. The device as claimed in claim 4, wherein a head end of the projecting portion of the button is disposed with a spring-fixing end.

6. The device as claimed in claim 5, wherein the slider is arranged with a spring-fixing end that corresponds to the spring-fixing end of the button; a compression spring is positioned between the spring-fixing end of the button and the spring-fixing end of the slider and used for providing the elastic recovery force by which the button being pressed is turned back.

7. The device as claimed in claim 1, wherein a second rack toward the concave space is disposed on one side of the fixing member opposite to the side of the fixing member arranged with the rack.

8. The device as claimed in claim 7, wherein a bottom surface of the concave space of the slider is set with a groove while a rotary damper is mounted in the groove; the rack that is toward the concave space and disposed on the fixing member is engaged with a gear that rotates on the rotary damper for damping.

9. The device as claimed in claim 1, wherein a top cover is disposed over the slider and the armrest pad of the armrest is covered over the top cover.

* * * * *